US006249995B1

(12) United States Patent
Bush

(10) Patent No.: US 6,249,995 B1
(45) Date of Patent: Jun. 26, 2001

(54) LINKAGE CONNECTOR FOR EXCAVATOR BUCKET

(76) Inventor: David E. Bush, Rt. 1 Box 77, Gary, TX (US) 75643

( * ) Notice: Subject to any disclaimer, the term of this patent is extended or adjusted under 35 U.S.C. 154(b) by 0 days.

(21) Appl. No.: 09/505,015

(22) Filed: Feb. 15, 2000

(51) Int. Cl.[7] ..... E02F 3/28

(52) U.S. Cl. ..... 37/442; 403/151; 414/339

(58) Field of Search ..... 37/411, 442, 444, 37/468, 407, 182, 461, 466, 264; 403/150, 151, 152, 153, 52; 384/192; 172/810, 811, 816; 414/723, 695.6, 691, 338, 339

(56) References Cited

U.S. PATENT DOCUMENTS

| | | | | |
|---|---|---|---|---|
| 3,150,900 | * | 9/1964 | Bruenig | 384/192 |
| 3,401,964 | * | 9/1968 | Johnson | 403/151 |
| 3,543,863 | * | 12/1970 | Ball et al. | 172/273 |
| 4,109,976 | * | 8/1978 | Koch | 384/192 |
| 4,133,121 | * | 1/1979 | Hemphill | 37/444 |
| 4,251,122 | * | 2/1981 | McCloskey | 384/192 |
| 4,422,366 | | 12/1983 | Weyer | 91/26 |
| 4,813,163 | * | 3/1989 | Livingston et al. | 414/723 X |
| 4,906,161 | | 3/1990 | Weyer | 414/705 |
| 5,066,188 | * | 11/1991 | Bush | 414/339 |
| 5,145,313 | | 9/1992 | Weyer | 414/723 |
| 5,628,577 | * | 5/1997 | Ribeiro et al. | 403/150 |
| 5,901,480 | * | 5/1999 | Shamblin | 37/444 |
| 5,951,192 | * | 9/1999 | Collins | 403/150 |
| 6,042,295 | * | 3/2000 | Barden | 403/158 |
| 6,158,950 | * | 12/2000 | Wilt et al. | 414/723 |

* cited by examiner

*Primary Examiner*—Victor Batson
(74) *Attorney, Agent, or Firm*—John M Harrison

(57) ABSTRACT

A linkage connection which loosely and yet securely mounts an excavator bucket on a hydraulic excavator and facilitates enhanced positioning capability of the bucket on the excavator, particularly in confined areas. In a preferred embodiment the linkage connection includes a pair of bucket flanges which extend rearwardly from the excavator bucket, in horizontally spaced-apart relationship to each other. A pair of circular linkage openings is provided in vertically spaced-apart relationship with each other in each bucket flange, and a circular pin plate is disposed in each linkage opening. A linkage pin extends through the pin plates of each bucket flange for connection to the rotation linkage and dipper stick linkage, respectively, of a hydraulic excavator, such that the bucket is supported on the respective pin plates. Each pin plate has a diameter which is slightly smaller than that of the corresponding linkage opening in which the pin plate is disposed, such that the excavator bucket is capable of slight, substantially universal shifting, tilting and pivoting movements on the hydraulic excavator. Accordingly, during the unloading or cleaning of ballast, rock or other particulate matter from gondola railcars, the excavator bucket is capable of reaching corners and crevices of the railcar in a more effective manner than can be achieved with conventional, fixed articulation hydraulic excavator buckets.

9 Claims, 4 Drawing Sheets

LINKAGE CONNECTOR FOR EXCAVATOR BUCKET

BACKGROUND OF THE INVENTION

Field of the Invention

This invention relates to buckets for hydraulic excavators, front-end loaders and backhoes and more particularly, to a linkage connection which loosely and yet securely mounts a hydraulic excavator or other bucket on a hydraulic excavator or alternative equipment and facilitates enhanced positioning capability of the bucket on the equipment, particularly in the unloading or cleaning of ballast, rock or other particulate matter from gondola rail cars and other confined areas. In a preferred embodiment the linkage connection is characterized by a pair of bucket flanges which extend rearwardly from the typically elongated bucket, in horizontally spaced-apart relationship with respect to each other. A pair of circular linkage openings is provided in vertically spaced-apart relationship with respect to each other in each bucket flange, a circular pin plate is disposed in each linkage opening and a linkage pin extends through the circular pin plate. A rotation linkage and a dipper stick linkage, typically of a hydraulic excavator, are connected to the linkage pins of the respective pin plates of each bucket flange, such that the excavator bucket is supported on the pin plates. The diameters of the pin plates are slightly smaller than the diameters of the respective linkage openings in which the pin plates are disposed, such that the excavator bucket is capable of slight, substantially universal movement on the hydraulic excavator, most importantly tilting in a generally vertical plane, pivoting in a generally horizontal plane and generally vertical and horizontal shifting movements. Accordingly, because of the loose yet secure articulation of the bucket on the excavator, front-end loader or backhoe, during the unloading or cleaning of the particulate material from gondola railcars the bucket is capable of substantially following or conforming to the contour of the rail car floor and walls as the bucket is maneuvered to scoop the material from the car. This facility enables the bucket to reach corners and crevices of the railcar in a more effective manner than can be achieved with conventional, fixed articulation hydraulic buckets. In another embodiment, the linkage connection is characterized by a pair of side bucket flanges which extend rearwardly from the bucket in horizontally spaced-apart relationship and a middle bucket flange which extends rearwardly from the bucket between and slightly above the side bucket flanges. The rotation linkage of the hydraulic excavator is connected to the middle bucket flange and the dipper stick linkages of the machine are connected to the respective side bucket flanges, by means of the respective linkage pins and pin plates which are disposed in linkage openings provided in the respective bucket flanges.

Conventional hydraulic excavators, front-end loaders and backhoes typically include a pair of parallel "dipper sticks" which extend from the cab and are attached by means of pivot pins to respective flanges which are provided on the rear surface of an elongated bucket. Typically, a rotation link is connected to the bucket, either directly above each dipper stick or above and between the dipper sticks, such that piston-actuated movement of the rotation link causes the bucket to pivot on the dipper sticks. While the bucket can be rotated on the dipper sticks in a generally vertical, forwardly-extending plane defined by the dipper sticks and the rotation link or links, this arrangement does not enable slight tilting in a vertical plane, pivoting in a horizontal plane or vertical and horizontal shifting movements of the bucket on the machine.

Hydraulic excavators and other hydraulic equipment are commonly used to clean or unload ballast, rock, dirt or other particulate material from gondola railcars, typically by lowering the excavator into the railcar and operating the excavator bucket to scoop the material from the floor of the car. Because the excavator bucket is conventionally rigidly attached to the excavator, the rigid excavator bucket is incapable of following the contour of the floor and walls of the railcar and the excavator thus must be repeatedly repositioned in the car when the material is being removed from the crevices and corners where the walls meet each other and the floor of the car. This necessity of repeatedly repositioning the excavator is particularly problematic due to the narrow confines of the gondola railcar, which substantially limits the repositioning capability of the excavator. Consequently, the fixed articulation buckets of conventional hydraulic excavators and other equipment, such as front-end loaders and backhoes, are substantially incapable of reaching corners and crevices of the railcar, and the ballast or other particulate matter must typically be manually removed from these inaccessible areas, thus requiring additional time, labor and expense in the unloading or cleaning operation.

DESCRIPTION OF THE PRIOR ART

Various mechanisms are known in the art for mounting a hydraulic bucket on a hydraulic excavator, a front-end loader or a backhoe in such a manner that the bucket can be tilted from side to side, as needed during material handling operations of the machine. U.S. Pat. No. 4,422,366, dated Dec. 27, 1983, to Paul P. Weyer, discloses a "Rotary Helical Actuator" which is adapted for swinging the boom of a front end loader. The rotary helical actuator is characterized by hydraulic cushioning and rapid initiation of movement. The actuator is provided with an elongated cylindrical bearing which is integral with the shaft of the actuator for increasing the radial and movement load-carrying capacity of the actuator without increasing its length. A "Tiltable Bucket Assembly" is described in U.S. Pat. No. 4,906,161, dated Mar. 6, 1990, to Paul P. Weyer. The bucket assembly is characterized by a bucket fitted with a forward bucket clevis and a rear bucket clevis. An actuator is connected to the forward bucket clevis, and an output shaft rotatably disposed in the actuator is connected to the rear bucket clevis. A bracket provided on the actuator includes a pair of devises for pivotal attachment to the dipper stick and rotation link of a backhoe. A linear-to-rotary transmission device disposed in the actuator produces rotational movement of the output shaft relative to the actuator, and produces rotational movement of the shaft relative to the actuator in order to facilitate lateral tilting of the bucket in a plane disposed generally transverse to the forward rotational plane of the bucket. U.S. Pat. No. 5,145,313, dated Sep. 8, 1992, to Paul P. Weyer, details a "Quick Disconnect Bucket Actuator", characterized by a bucket fitted with a forward bucket clevis and a rear bucket clevis. An actuator is connected to the forward bucket clevis, and an output shaft is rotatably disposed in the actuator is connected to the rear bucket clevis. A bracket provided on the actuator includes a pair of devises for pivotal attachment to the dipper stick and rotation link of a backhoe. The output shaft is fitted with a pair of shaft attachment forks for attaching the shaft to the respective bucket clevises of the bucket. One pair of shaft attachment forks is attached to and moves axially with a member which is selectively extendable relative to the shaft to move the attachment forks between a locking position holding the bucket and a release position allowing disconnection of the bucket. A linear-to-rotary transmission device disposed in the actuator produces rotational movement of the output shaft relative to the actuator, and produces rotational movement of the shaft relative to the actuator in order to facilitate lateral tilting of the bucket in a plane disposed generally transverse to the forward rotational plane of the bucket.

An object of this invention is to provide a linkage connection for loosely, yet securely, mounting an excavator bucket on hydraulic equipment such as a hydraulic excavator, front-end loader or backhoe.

Another object of this invention is to provide a linkage connection for enhancing the positioning capability of an excavator bucket on an excavator during material handling operations of the excavator.

Still another object of this invention is to provide a linkage connection for mounting a hydraulic bucket on a hydraulic excavator, a front-end loader or a backhoe, which linkage connection facilitates slight, substantially universal shifting, tilting and pivoting movement of the bucket on the machine, whereby the bucket is capable of reaching crevices and corners of a gondola railcar or other otherwise inaccessible or confined areas without requiring repeated repositioning of the machine in the car during unloading or cleaning of ballast, rock, dirt or other particulate matter from the car or other area.

Yet another object of this invention is to provide a linkage connection for a hydraulic bucket, characterized by a pair of bucket flanges which extend rearwardly from the typically elongated bucket, in horizontally spaced-apart relationship to each other; a pair of circular linkage openings provided in vertically spaced-apart relationship with each other in each bucket flange; a circular pin plate disposed in each linkage opening; and a linkage pin which extends through each pin plate for connection to the rotation linkage and dipper stick linkage, respectively, of a hydraulic excavator, front-end loader or backhoe, such that the bucket is supported on the respective pin plates. Each pin plate has a diameter which is slightly smaller than that of the corresponding linkage opening in which the pin plate is disposed, such that the bucket is capable of slight, substantially universal pivoting, tilting and shifting movements on the machine.

A still further object of this invention is to provide a linkage connection for loosely and yet securely mounting a hydraulic excavator bucket on a hydraulic excavator, which linkage connection is characterized by a pair of side bucket flanges which extend rearwardly from the excavator bucket in spaced-apart relationship to each other; a middle bucket flange which extends rearwardly from the excavator bucket between and slightly above the side bucket flanges; a circular linkage opening provided in each side bucket flange and the middle bucket flange; a circular pin plate disposed in each linkage opening; a linkage pin which extends through the pin plate of the middle bucket flange for connection to the rotation linkage of a hydraulic excavator; and linkage pins which extend through the respective pin plates of the side bucket flanges for connection to the respective dipper stick linkages of the hydraulic excavator, such that the excavator bucket is supported on the respective pin plates. Each pin plate has a diameter which is slightly smaller than that of the corresponding linkage opening in which the pin plate is disposed, such that the excavator bucket is capable of slight, substantially universal movement on the hydraulic excavator, most importantly pivoting in a generally horizontal plane, tilting in a generally vertical plane and generally horizontal and vertical shifting movements.

SUMMARY OF THE INVENTION

These and other objects of the invention are provided in a linkage connection which loosely and yet securely mounts an excavator or alternative bucket on a hydraulic excavator, front-end loader or backhoe and facilitates enhanced positioning capability of the bucket on the machine, particularly in the unloading or cleaning of ballast, rock or other particulate matter from gondola railroad cars or other confined areas. In a preferred embodiment the linkage connection is characterized by a pair of bucket flanges which extend rearwardly from a typically elongated excavator bucket, in horizontally spaced-apart relationship with respect to each other. A pair of circular linkage openings is provided in vertically spaced-apart relationship with respect to each other in each bucket flange, a circular pin plate is disposed in each linkage opening and a linkage pin extends through the circular pin plate. A rotation linkage and a dipper stick linkage of a hydraulic excavator are connected to the linkage pins of the respective pin plates of each bucket flange, such that the excavator bucket is supported on the pin plates. The diameters of the pin plates are slightly smaller than the diameters of the respective linkage openings in which the pin plates are disposed, such that the excavator bucket is capable of slight, substantially universal movement on the hydraulic excavator, most importantly tilting in a generally vertical plane, pivoting in a generally horizontal plane and generally vertical and horizontal shifting movements. Accordingly, because of the loose articulation of the excavator bucket on the excavator, during the unloading or cleaning of the particulate material from gondola railroad cars the excavator bucket is capable of substantially following or conforming to the contour of the railroad car floor and walls as the bucket is maneuvered to scoop the material from the car. Consequently, the excavator bucket is capable of reaching corners and crevices of the railroad car in a more effective manner than can be achieved with conventional, fixed articulation hydraulic excavator buckets. In another embodiment, the linkage connection is characterized by a pair of side bucket flanges which extend rearwardly from the excavator bucket in horizontally spaced-apart relationship to each other and a middle bucket flange which extends rearwardly from the bucket between and slightly above the side bucket flanges. The rotation linkage of the hydraulic excavator is connected to the middle bucket flange, and the dipper stick linkages of the excavator are connected to the side bucket flanges by means of the respective linkage pins and pin plates which are disposed in linkage openings provided in the respective bucket flanges.

BRIEF DESCRIPTION OF THE DRAWINGS

The invention will be better understood by reference to the accompanying drawings, wherein.

DESCRIPTION OF THE PREFERRED EMBODIMENTS

Figure 7:
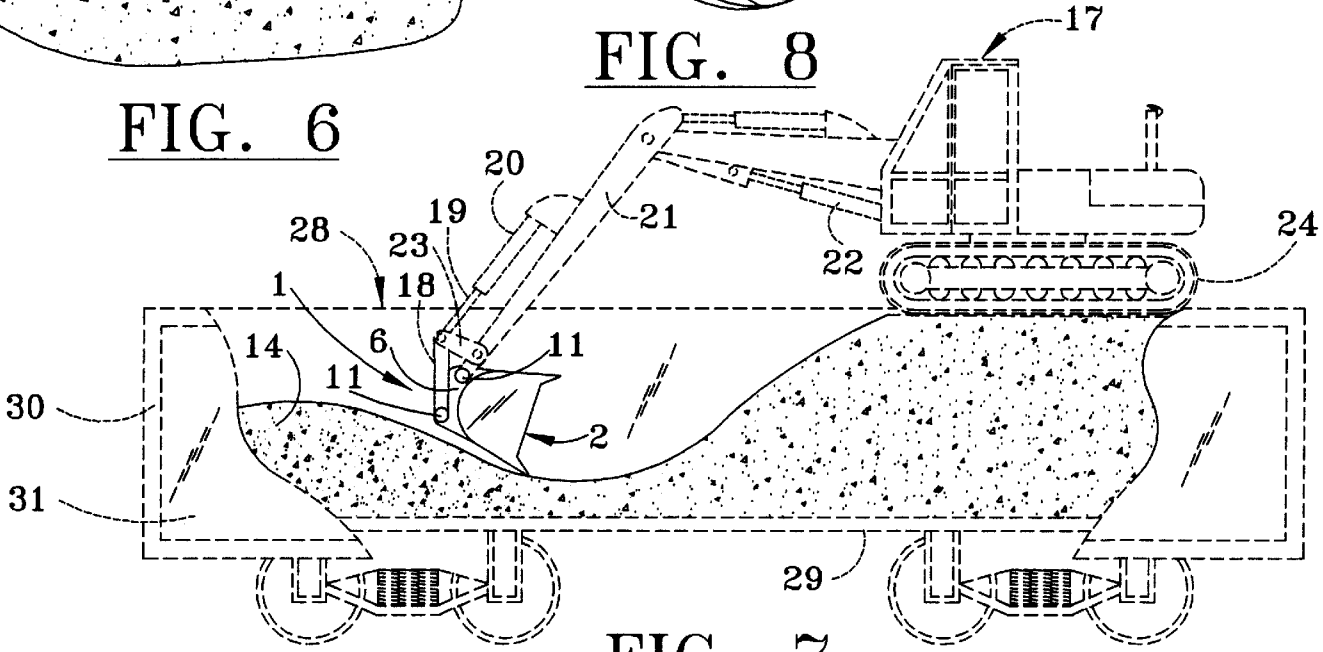
FIG. 7 is a side view, partially in section, of a conventional gondola railcar, with a hydraulic excavator shown positioned inside the railcar and an excavator bucket mounted on the excavator by means of the linkage connection, more particularly illustrating removal of ballast from the railcar by operation of the excavator.

Referring initially to FIGS. 1–5, 7, 11, 13 and 14 of the drawings, in a preferred embodiment the linkage connection of this invention is generally illustrated by reference numeral 1. The linkage connection 1 is designed to loosely and yet securely mount a typically elongated excavator bucket 2 on a conventional hydraulic excavator 17, as illustrated in FIG. 7, in order to render the excavator bucket 2 suitable for removing or cleaning ballast 14 or other particulate matter such as gravel dirt or sand from a gondola railcar 28, particularly the interior corners and crevices of the gondola railcar 28. As further illustrated in FIG. 7, the conventional hydraulic excavator 17 typically includes two pairs of rotation links 18 (one pair of which is illustrated), with the rotation links 18 of each pair attached to a corresponding rotation link piston 19, selectively extendible from a rotation link cylinder 20 which is mounted on the corresponding side of the hydraulic excavator 17. The hydraulic excavator 17 further typically includes two pairs of dipper stick links 21 which extend from the hydraulic excavator 17, beneath the respective pairs of rotation links 18. Each pair of dipper stick links 21 is connected to a dipper stick cylinder 22, mounted on the corresponding side of the hydraulic excavator 17. The pair of rotation links 18 and pair of dipper stick links 21 on each side of the hydraulic excavator 17 are typically connected to each other by means of a connecting link 23. Accordingly, the excavator bucket 2, connected to the respective pairs of dipper stick links 21 and rotation links 18 by means of the linkage connection 1 as hereinafter described, can be raised and lowered on the hydraulic excavator 17 by selective operation of the respective dipper stick cylinders 22 in concert. The excavator bucket 2 can be partially rotated in the clockwise or counterclockwise direction on both pairs of dipper stick links 21 by selective operation of the respective rotation link cylinders 20 in concert, in conventional fashion.

Figure 1:
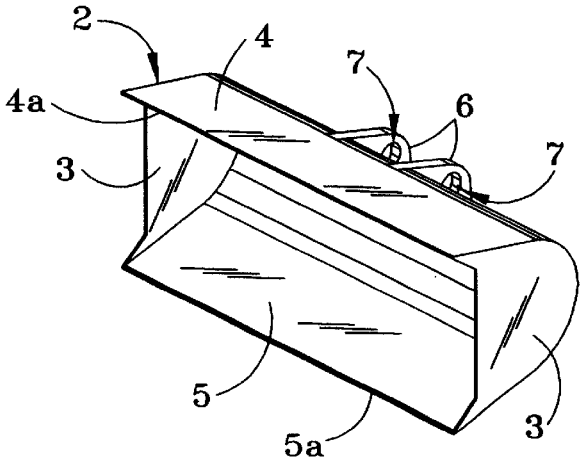
FIG. 1 is a perspective view of a hydraulic excavator bucket of a preferred embodiment of the linkage connection of this invention, with the excavator bucket removed from a hydraulic excavator.
Figure 2:
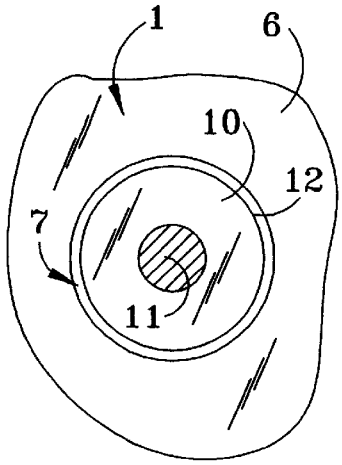
FIG. 2 is an enlarged, sectional view of a bucket flange component of the linkage connection, with a linkage opening provided in the bucket flange, a circular pin plate disposed in the linkage opening and a linkage pin extending through the pin plate.
Figure 3:
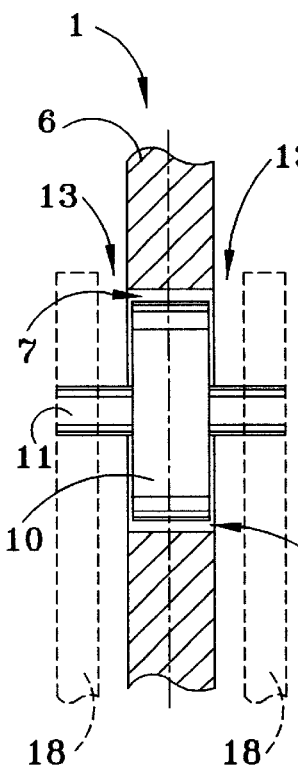
FIG. 3 is a sectional view of a bucket flange component of the linkage connection, with the excavator bucket positioned in the normal or straight configuration on the respective pin plates of the linkage connection.
Figure 4:
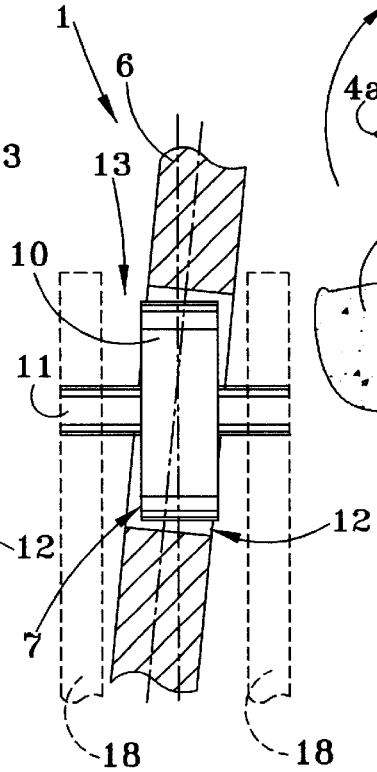
FIG. 4 is a sectional view of a bucket flange component of the linkage connection, with the excavator bucket positioned in an angled or tilted configuration on the respective pin plates of the linkage connection.
Figure 5:
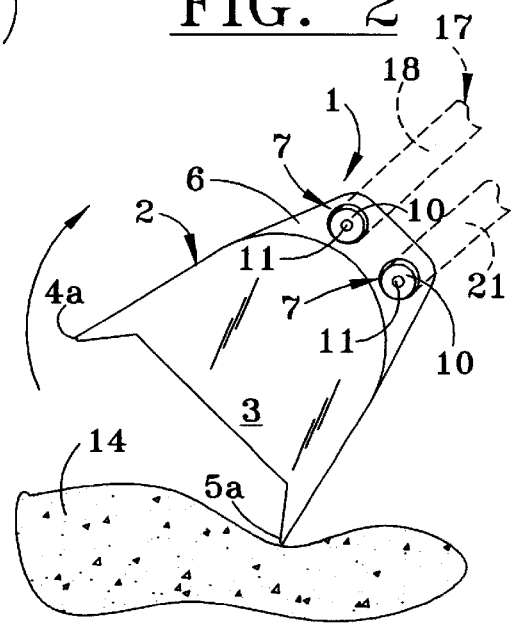
FIG. 5 is a side view of the excavator bucket illustrated in FIG. 1, connected to a hydraulic excavator (partially illustrated in phantom) by means of the linkage connection, more particularly illustrating forward scooping of particulate ballast into the excavator bucket by operation of the hydraulic excavator.
Figure 9:
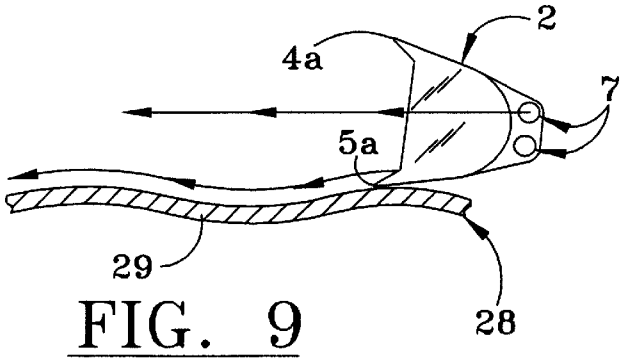
FIG. 9 is a side view of the hydraulic excavator bucket illustrated in FIG. 7, mounted on the hydraulic excavator (not illustrated), more particularly illustrating movement of the excavator bucket across the floor of the railroad car by operation of the excavator.
Figure 11:
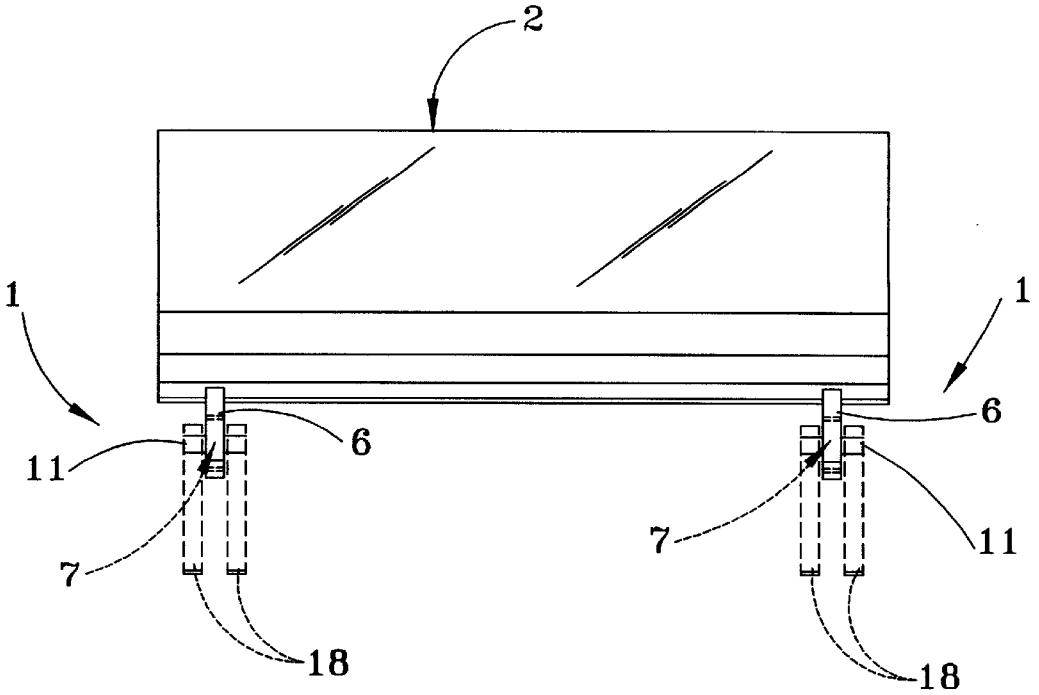
FIG. 11 is a top view of the hydraulic excavator bucket illustrated in FIG. 10, with the middle bracket removed and the bucket mounted on the respective rotation linkages by means of the linkage connection of this invention.

As illustrated in FIG. 1, the typically elongated excavator bucket 2 may be conventional and includes a top blade 4 having a top working edge 4*a*, which top blade 4 is continuous with a bottom blade 5 having a bottom working edge 5*a*. A pair of bucket side plates 3 joins the side edges of the top blade 4 and bottom blade 5. The linkage connection 1 of this invention includes a pair of bucket flanges 6 which extend rearwardly from typically welded attachment to the excavator bucket 2, in horizontally spaced-apart relationship with respect to each other. Alternatively, the bucket flanges 6 may be cast integrally with the excavator bucket 2. A pair of circular linkage openings 7 extends transversely through each bucket flange 6, with the linkage openings 7 of each bucket flange 6 provided in vertically spaced-apart relationship with respect to each other. A generally cylindrical or disc-shaped pin plate 10, having a diameter slightly smaller than the diameter of each linkage opening 7 and typically constructed of steel, is disposed in each linkage opening 7, as illustrated in FIGS. 2–4. Accordingly, a pivot space 12 is defined between each pin plate 10 and the edge of each corresponding linkage opening 7, and a typically steel linkage pin 11 extends transversely through substantially the center of each pin plate 10. As illustrated in FIG. 5, the linkage pin 11 of each pin plate 10 which is contained in the corresponding upper linkage opening 7 of each bucket flange 6, extends through the corresponding pair of rotation links 18 (illustrated in phantom) of the hydraulic excavator 17, with the rotation links 18 of each pair on respective sides of the corresponding bucket flange 6, as also illustrated in FIG. 11. In lke manner, as further illustrated in FIG. 5 the linkage pin 11 of each pin plate 10 which is contained in the corresponding bottom linkage opening 7 of each bucket flange 6 extends through a corresponding pair of dipper stick links 21 (also illustrated in phantom) of the hydraulic excavator 17, with the dipper stick links 21 of each pair on respective sides of the corresponding bucket flange 6. As illustrated in FIGS. 3 and 4, a shift space 13 separates each rotation link 18 (illustrated in phantom) of each rotation link 18 pair, and each dipper stick link 21 (FIG. 5, located beneath each pair of rotation links 18) of each dipper stick link 21 pair, from the corresponding bucket flange 6.

Figure 13:
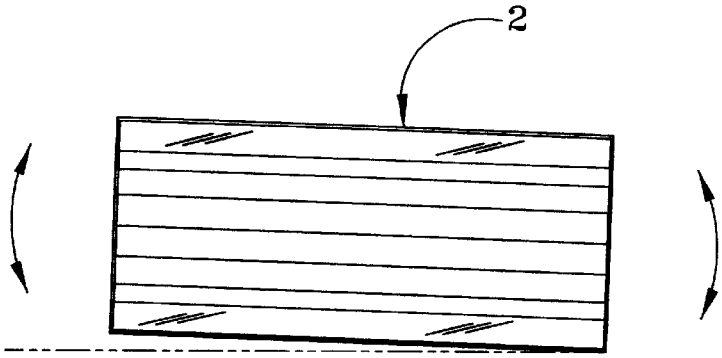
FIG. 13 is a front view of an excavator or front-end loader bucket, more particularly illustrating tilting of the bucket in a generally vertical plane.
Figure 14:
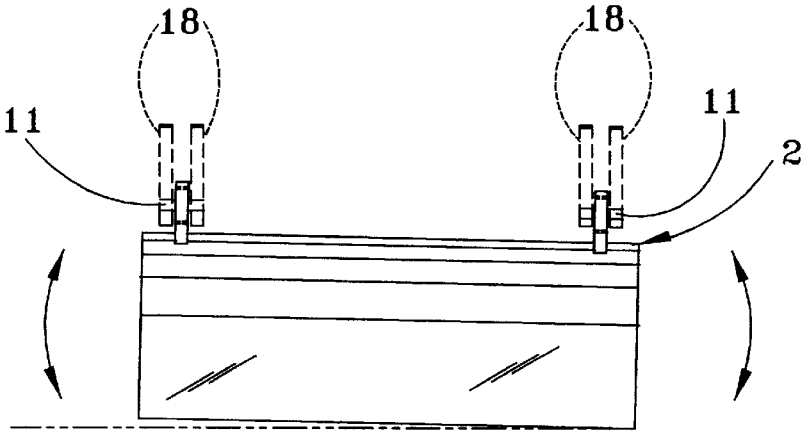
FIG. 14 is a top view of the excavator bucket, illustrated in FIG. 13, more particularly illustrating pivoting of the excavator bucket in a generally horizontal plane.

It will be appreciated by those skilled in the art that due to the pivot space 12 between each pin plate 10 and the edge of the corresponding linkage opening 7, the excavator bucket 2 is capable of substantially universal movement on the hydraulic excavator 17, as well as other hydraulic machines such as backhoes and front-end loaders, most importantly slight, substantially vertical shifting movements, tilting in a generally vertical plane as illustrated in FIG. 13 and pivoting in a generally horizontal plane, as illustrated in FIG. 14, on the respective pin plates 10, during removal of the ballast 14 from the gondola railcar 28 as hereinafter described. The magnitude of the vertical shifting movements of the excavator bucket 2 is limited by the width of the pivot space 12. The horizontal pivoting and vertical tilting movements of the excavator bucket 2 are limited by width of the shift space 13, since each pivoting bucket flange 6 contacts the parallel rotation links 18, as illustrated in FIG. 4, and the underlying parallel dipper stick links 21 (FIG. 5) as the excavator bucket 2 pivots or tilts on the pin plates 10. Moreover, due to the shift space 13, the excavator bucket 2 is capable of slight lateral shifting movements on the respective pin plates 10, between the parallel rotation links 18 and the parallel dipper stick links 21 of each pair, the magnitude of which lateral shifting movements is limited by the width of the shift space 13. The excavator bucket 2 is securely mounted on the pin plates 10, since each pin plate 10 is thicker than the width of the shift space 13 and thus, the corresponding bucket flange 6 engages one of the rotation links 18 and dipper stick links 21 of each pair before the bucket flange 6 can become dislodged from the pin plate 10, during the shifting, tilting or pivoting movements of the excavator bucket 2 on the pin plates 10. In a preferred embodiment each pin plate 10 has a diameter of about 6 inches, whereas each linkage opening 7 has a diameter of about 6.5 inches. It will be appreciated that the relative diameters of the pin plates 10 and respective linkage openings 7 can be selected depending on the desired width of the pivot space 12 and thus, the magnitude of the vertical shifting movements of the excavator bucket 2 on the excavator 17. Likewise, the width of the shift space 13 can be selected depending on the desired magnitude of the horizontal pivoting, vertical tilting and lateral shifting movements of the excavator bucket 2 on the excavator 17, as long as the size of the shift space 13 does not exceed the thickness of the pin plates 10.

Figure 8:
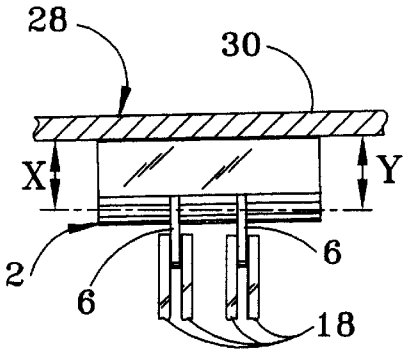
FIG. 8 is a top view, partially in section, of the excavator bucket and hydraulic excavator illustrated in FIG. 7, more particularly illustrating slight pivoting of the excavator bucket in a substantially horizontal plane on the excavator as the excavator bucket contacts the railroad car wall and conforms to the position of the wall, without having to reposition the hydraulic excavator in the railcar.
Figure 6:
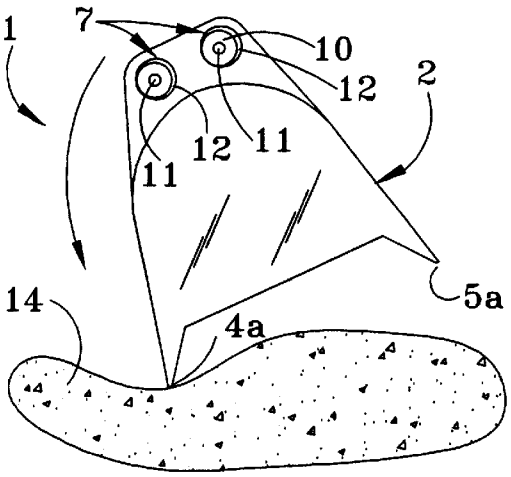
FIG. 6 is a side view of the excavator bucket, connected to a hydraulic excavator (not illustrated) by means of the linkage connection of this invention, more particularly illustrating rearward scooping of particulate ballast into the excavator bucket by operation of the hydraulic excavator.

Referring next to FIGS. 5–9 and 12 and initially to FIG. 7 of the drawings, in application the hydraulic excavator 17 (FIG. 7) and the front-end loader 17*a* (FIG. 12) are operated to remove ballast, dirt, sand, gravel or other particulate matter 14 from the interior of the gondola railcar 28 by initially lowering the hydraulic excavator 17 or the front-end loader 17*a* into the railcar 28. As the hydraulic excavator 17 or front-end loader 17*a* is repeatedly driven forwardly, the rotation link cylinders 20 and dipper stick cylinders 22 of the hydraulic excavator 17 or front-end loader 17*a* are operated to maneuver the excavator bucket 2 to scoop the ballast 14 from the floor 29 of the railcar 28, and deposit the ballast 14 outside the railcar 28. Accordingly, the linkage connection 1 enables upward maneuvering of the excavator bucket 2, as illustrated in FIG. 5, as well as downward maneuvering of the excavator bucket 2, as illustrated in FIG. 6, in conventional fashion to lift or scoop the major portion of the ballast 14 from the floor 29 of the railcar 28. It will be appreciated from a consideration of FIG. 9 that the excavator bucket 2 is capable of reaching slight depressions or dips in an irregularly-shaped floor 29 of the railcar 28, as required, as the excavator bucket 2 is maneuvered across the floor 29, since the pivot space 12 (FIG. 2) between each pin plate 10 and the edge of the corresponding linkage opening 7 enables the slight, substantially vertical movements of the excavator bucket 2 on the respective pin plates 10 as the rotation links 18 and dipper stick links 21 of the excavator 17 or front-end loader 17*a* remain at a substantially constant height above the railcar floor 29. The magnitude of the vertical movements of the excavator bucket 2 on the pin plates 10 is limited by the width of the pivot space 12, as heretofore described. After most of the ballast 14 has been scooped from the railcar 28, a substantial quantity of the ballast 14 remains in the crevices and corners where the front wall 30 and the side walls 31 join each other and the floor 29 of the railcar 28. As heretofore described with respect to FIGS. 3, 4 and 14, the pivot space 12 between each pin plate 10 and the edge of the corresponding linkage opening 7 enables slight pivoting of the bucket flanges 6 and attached excavator bucket 2 in a generally horizontal plane on the respective pin plates 10, the magnitude of which horizontal pivoting is limited by the width of the shift space 13. It will be appreciated by those skilled in the art that the excavator bucket 2 can thus be maneuvered flatly against the front wall 30 of the railcar 28, even though the excavator 17 or front-end loader 17*a* may be positioned at a slight angle with respect to the front wall 30, as illustrated in FIG. 8. Accordingly, the bottom working edge 5*a* (FIG. 1) of the excavator bucket 2 is capable of reaching the crevice between the floor 29 and front wall 30 of the railcar 28 and scooping the ballast 14 from the crevice as the excavator 17 or front-end loader 17*a* is driven forwardly and the dipper stick cylinders 22 are operated to lift the excavator bucket 2, without requiring positioning of the hydraulic excavator 17 or front-end loader 17*a* in parallel relationship to the front wall 30. It will be further appreciated from a consideration of FIG. 12 that the horizontal pivoting capability of the excavator bucket 2, in combination with the lateral shifting capability of the excavator bucket 2 imparted by the shift space 13, renders the excavator bucket 2 capable of reaching ballast 14 in the corners between the front wall 30, either side wall 31 and floor 29 of the railcar 28. Such positioning of the excavator bucket 2 in the corner between the front wall 30 and either side wall 31 cannot be achieved using conventional, fixed articulation excavator buckets 2, since the excavator bucket 2 is rigidly attached to the excavator 17 or front-end loader 17*a* and the wheels or tracks 24 of the hydraulic excavator 17 or front-end loader 17*a* prevent the excavator 17 from being maneuvered into sufficiently close proximity to the side wall 31 for the purpose.

Figure 10:
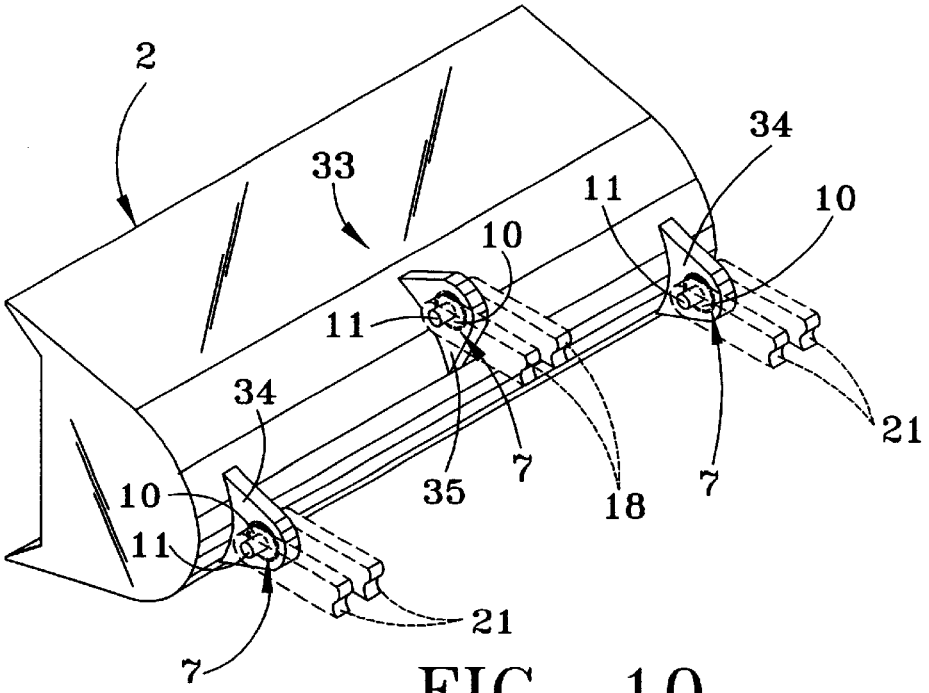
FIG. 10 is a perspective view of another embodiment of the linkage connection of this invention, illustrated on a front-end loader bucket.
Figure 12:
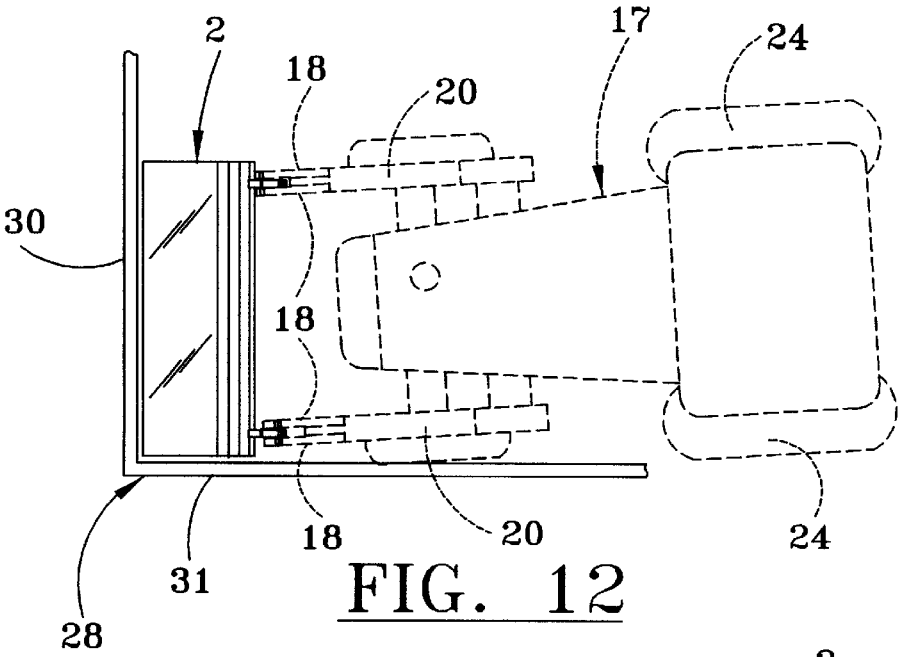
FIG. 12 is a top view of a front-end loader, with the bucket maneuvered into a corner of the gondola railcar in another application of the linkage connection.

Referring next to FIGS. 10 and 12 of the drawings, some front-end loaders 17*a* (FIG. 12) are equipped with one rotation link cylinder 20 in the middle rather than on each side of the hydraulic excavator 17, with the dipper stick cylinders 22 provided on respective sides of the hydraulic excavator 17 as described above with respect to FIG. 7. Accordingly, in another embodiment of the linkage connection, generally illustrated by reference numeral 33, the excavator bucket 2 is fitted with a pair of side bucket flanges 34 which extend rearwardly from the excavator bucket 2 in horizontally-spaced relationship to each other, each of which side bucket flanges 34 is provided with a transversely-extending linkage opening 7. A middle bucket flange 35, likewise fitted with a linkage opening 7, in like manner extends rearwardly from the excavator bucket 2. A circular pin plate 10 is disposed in each linkage opening 7 and a linkage pin 11 extends transversely through each pin plate 10, as described above with respect to FIGS. 2–4. A pair of dipper stick links 21 (illustrated in phantom) of the front-end loader 17*a* engages the linkage pin 11 of each side bucket flange 34, and the pair of rotation links 18 of the front-end loader 17*a* engages the linkage pin 11 of the middle bucket flange 35. Accordingly, as heretofore described with respect to the embodiment of FIGS. 1–4, the excavator bucket 2 is capable of slight, substantially universal shifting, tilting and pivoting movements on the 17*a* due to the pivot space 12 between each pin plate 10 and the edge of the corresponding linkage opening 7, and the shift space 13, and is effective for reaching the crevices and corners of a gondola railcar 28 (FIG. 7) in the unloading of ballast 14 or other particulate matter from the railcar 28, as heretofore described.

It will be appreciated by those skilled in the art that the linkage connection of this invention is useful for mounting excavator buckets on hydraulic excavators and earth-moving equipment of every description, including for example, front-end loaders and backhoe loaders, as well as excavators, under circumstances in which slight pivoting, tilting or shifting of the excavator bucket would enhance access of the bucket to otherwise inaccessible areas, such as when material-moving operations in gondola railcars or other confined areas are required. As described above, the embodiment of the invention described with respect to FIGS. 1–4 of the drawings can be readily mounted on a conventional hydraulic excavator 17 commonly fitted with a pair of rotation links 18 and a pair of dipper stick links 21, and the embodiment of the invention described above with respect to FIGS. 10 and 12 can be mounted on other machines such as the front-end loader 17*a*, designed with a pair of rotation links 18 at the center of the front-end loader 17*a* and a pair of dipper stick links 21 at respective sides of the front-end loader 17*a*.

Referring again to FIGS. 1 and 10 of the drawings, the bucket flanges 6 of the embodiment illustrated in FIG. 1 and the side bucket flanges 34 and middle bucket flange 35 of the embodiment illustrated in FIG. 10 can be constructed of various sizes and at selected spacings with respect to each other, depending on the size of the excavator bucket 2 and the hydraulic excavator 17 or the front-end loader 17*a*. While the bucket flanges 6 are illustrated as a one-piece construction in FIG. 1, it will be recognized and understood by those of ordinary skill in the art that the respective linkage openings 7 can be provided in two pairs of separate, vertically-spaced bucket flanges 6 on the excavator bucket 2, as desired.

While the preferred embodiments of the invention have been described above, it will be recognized and understood that various modifications can be made in the invention and the appended claims are intended to cover all such modifications which may fall within the spirit and scope of the invention.

Having described my invention with the particularity set forth above, what is claimed is:

1. An excavator bucket and bucket linkage connection for mounting an excavator bucket on a rotation linkage and a dipper stick linkage of a hydraulic excavator, said linkage connection comprising a first linkage opening provided in the excavator bucket; a second linkage opening provided in the excavator bucket in vertically spaced-apart relationship to said first linkage opening; a first pin plate disposed in said first linkage opening for engaging the dipper stick linkage of the hydraulic excavator; and a second pin plate disposed in said second linkage opening for engaging the rotation linkage of the hydraulic excavator, wherein said first pin plate has a diameter smaller than a diameter of said first linkage opening, said second pin plate has a diameter smaller than a diameter of said second linkage opening, said dipper stick linkage is spaced from said first pin plate and said rotation linkage is spaced from said second pin plate, whereby the excavator bucket is capable of substantially universal pivoting, tilting and shifting movements on the hydraulic excavator.

2. The linkage connection of claim 1 comprising at least one bucket flange provided on the excavator bucket and wherein said first linkage opening and said second linkage opening extend through said at least one bucket flange in vertically spaced-apart relationship to each other.

3. The linkage connection of claim 2 wherein said at least one bucket flange comprises a pair of bucket flanges provided on the excavator bucket in horizontally spaced-apart relationship to each other and wherein said first linkage opening and said second linkage opening extend through said pair of bucket flanges, respectively, in vertically spaced-apart relationship to each other.

4. The linkage connection of claim 1 comprising a pair of side bucket flanges provided on the excavator bucket in horizontally spaced-apart relationship to each other and a middle bucket flange provided on the excavator bucket between and above said middle bucket flanges, and wherein said first linkage opening is provided in said side bucket flanges, respectively, and said second linkage opening is provided in said middle bucket flange.

5. An excavator bucket and bucket linkage connection for mounting an excavator bucket on a rotation linkage and a dipper stick linkage of a hydraulic excavator, said linkage connection comprising a first linkage opening provided in the excavator bucket, a first pin plate disposed in said first linkage opening and a first linkage pin extending through substantially a center of said first pin plate for engaging the dipper stick linkage of the hydraulic excavator; a second linkage opening provided in the excavator bucket in vertically spaced-apart relationship to said first linkage opening, a second pin plate disposed in said second linkage opening and a second linkage pin extending through substantially a center of said second pin plate for engaging the rotation linkage of the hydraulic excavator, wherein said first pin plate has a diameter smaller than a diameter of said first linkage opening, said second pin plate has a diameter smaller than a diameter of said second linkage opening, said dipper stick linkage is spaced from said first pin plate and said rotation linkage is spaced from said second pin plate, whereby said excavator bucket is capable of substantially universal pivoting, tilting and shifting movements on the hydraulic excavator.

6. The linkage connection of claim 5 comprising at least one bucket flange provided on the excavator bucket and wherein said first linkage opening and said second linkage opening extend through said at least one bucket flange in vertically spaced-apart relationship to each other.

7. The linkage connection of claim 6 wherein said at least one bucket flange comprises a pair of bucket flanges provided on the excavator bucket in horizontally spaced-apart relationship to each other and wherein said first linkage opening and said second linkage opening extend through said pair of bucket flanges, respectively, in vertically spaced-apart relationship to each other.

8. The linkage connection of claim 5 comprising a pair of side bucket flanges provided on the excavator bucket in horizontally spaced-apart relationship to each other and a middle bucket flange provided on the excavator bucket between and above said middle bucket flanges, and wherein said first linkage opening is provided in said side bucket flanges, respectively, and said second linkage opening is provided in said middle bucket flange.

9. An excavator bucket and bucket linkage connection for loosely mounting an excavator bucket on a rotation linkage and a dipper stick linkage of a hydraulic excavator, said linkage connection comprising a pair of upper bucket flanges provided on the excavator bucket in horizontally spaced-apart relationship with respect to each other and a pair of lower bucket flanges provided on the excavator bucket in horizontally spaced-apart relationship with respect to each other, said pair of upper bucket flanges provided in vertically spaced-apart relationship to said pair of lower bucket flanges; a first linkage opening provided in said pair of lower bucket flanges, respectively, and a second linkage opening provided in said pair of upper bucket flanges, respectively; a first pin plate disposed in said first linkage opening and a first linkage pin extending through substantially a center of said first pin plate for engaging the dipper stick linkage of the hydraulic excavator; a second pin plate disposed in said second linkage opening and a second linkage pin extending through substantially the center of said second pin plate for engaging the rotation linkage of the hydraulic excavator, wherein said first pin plate has a diameter smaller than a diameter of said first linkage opening, said second pin plate has a diameter smaller than a diameter of said second linkage opening, said dipper stick linkage is spaced from said first pin plate and said rotation linkage is spaced from said second pin plate, whereby said excavator bucket is capable of substantially universal pivoting, tilting and shifting movements on the hydraulic excavator.

* * * * *